US009303895B1

(12) United States Patent
Grant

(10) Patent No.: US 9,303,895 B1
(45) Date of Patent: Apr. 5, 2016

(54) WINDOW AIR CONDITIONER INSTALLATION SYSTEM

(76) Inventor: Merritt A. A. Grant, Brooklyn, NY (US)

( * ) Notice: Subject to any disclaimer, the term of this patent is extended or adjusted under 35 U.S.C. 154(b) by 478 days.

(21) Appl. No.: 13/489,185

(22) Filed: Jun. 5, 2012

Related U.S. Application Data

(60) Provisional application No. 61/520,260, filed on Jun. 7, 2011.

(51) Int. Cl.
*F24F 13/32* (2006.01)
*F24F 1/02* (2011.01)

(52) U.S. Cl.
CPC ..... *F24F 13/32* (2013.01); *F24F 1/027* (2013.01); *F24F 2221/20* (2013.01)

(58) Field of Classification Search
CPC ..... F24F 13/32; F24F 1/027; F24F 2221/20; F28F 9/00; F28F 9/001; F28F 9/002
USPC ..... 165/67, 68, 149; 62/262; 248/209, 236, 248/208, 241; 182/57, 62, 60; 108/46, 42, 108/47, 48
See application file for complete search history.

(56) References Cited

U.S. PATENT DOCUMENTS 1,351,434 A * 8/1920 Newton ..... 182/62
1,521,902 A * 1/1925 Mott ..... 108/42
1,531,159 A * 3/1925 Timmons ..... 248/236
1,682,060 A * 8/1928 Banks ..... 211/43
1,809,216 A * 6/1931 Quandt ..... 248/208
1,872,740 A * 8/1932 James ..... 108/149
2,316,704 A * 4/1943 Moore ..... 62/262
2,628,052 A * 2/1953 Cira ..... 248/236
2,717,139 A * 9/1955 Jewell ..... 248/208
2,880,952 A * 4/1959 Moore et al. ..... 248/208
2,889,764 A * 6/1959 McGrath et al. ..... 454/204
2,943,834 A * 7/1960 Kelly et al. ..... 248/208
2,946,274 A * 7/1960 Grimes, Jr. ..... 454/203
3,273,843 A * 9/1966 Bell, Jr. et al. ..... 248/208
3,394,910 A * 7/1968 Ulich ..... 248/208
5,112,015 A * 5/1992 Williams ..... 248/236
5,553,824 A * 9/1996 Dutra, Jr. ..... 248/346.07
5,967,478 A * 10/1999 Tynes ..... 248/241
7,350,759 B1 * 4/2008 Gray ..... 248/644
7,753,334 B2 * 7/2010 Schreiber ..... 248/351

* cited by examiner

*Primary Examiner* — M. Alexandra Elve
*Assistant Examiner* — Eric Ruppert

(57) ABSTRACT

A plate assembly includes upper and lower plates. The upper plate has down turned inner and outer edges receiving inner and outer edges of the lower plate. In this manner lateral shifting is facilitated. The upper and lower plates have upturned left and right side edges. Left and right outer supports have upper ends slidably received on the upturned left and right side edges. The outer supports have lower ends positionable against a region beneath a sill of a window opening. A support bar has a central section attached to the lower surface of the lower plate adjacent to the inner edge. Telescoping sections are slidably received in the central section. The telescoping sections have forwardly extending clamps.

1 Claim, 3 Drawing Sheets

WINDOW AIR CONDITIONER INSTALLATION SYSTEM

RELATED APPLICATION

This application is based upon Provisional Application No. 61/520,260 filed Jun. 7, 2011, entitled "Window Air Conditioner Installation System" the subject matter of which is incorporated herein by reference.

BACKGROUND OF THE INVENTION

1. Field of the Invention

The present invention relates to a window air conditioner installation system and more particularly pertains to receiving and supporting a window air conditioner and for adjusting a supporting surface as a function of the size of the air conditioner, all without modifying the environment of the installation, the receiving and supporting being done in a safe, convenient and economical manner.

2. Description of the Prior Art

The use of window air conditioner installation systems of known designs and configurations is known in the prior art. More specifically, window air conditioner installation systems of known designs and configurations previously devised and utilized for the purpose of installing air conditioners in windows are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a window air conditioner installation system that allows receiving and supporting a window air conditioner and adjusting a supporting surface as a function of the size of the air conditioner, all without modifying the environment of the installation, the receiving and supporting being done in a safe, convenient and economical manner.

In this respect, the window air conditioner installation system according to the present invention substantially departs from the conventional concepts and designs of the prior art, and in doing so provides an apparatus primarily developed for the purpose of receiving and supporting a window air conditioner and adjusting a supporting surface as a function of the size of the air conditioner, all without modifying the environment of the installation, the receiving and supporting being done in a safe, convenient and economical manner.

Therefore, it can be appreciated that there exists a continuing need for a new and improved window air conditioner installation system which can be used for receiving and supporting a window air conditioner and adjusting a supporting surface as a function of the size of the air conditioner, all without modifying the environment of the installation, the receiving and supporting being done in a safe, convenient and economical manner. In this regard, the present invention substantially fulfills this need.

SUMMARY OF THE INVENTION

In view of the disadvantages inherent in the known types of installation systems of known designs and configurations now present in the prior art, the present invention provides an improved window air conditioner installation system. As such, the general purpose of the present invention, which will be described subsequently in greater detail, is to provide a new and improved window air conditioner installation system and method which has all the advantages of the prior art and none of the disadvantages.

To attain this, the present invention essentially comprises a window air conditioner installation system. A plate assembly includes upper and lower plates. The upper plate has down turned inner and outer edges receiving inner and outer edges of the lower plate. In this manner lateral shifting is facilitated. The upper and lower plates have upturned left and right side edges. Left and right outer supports have upper ends slidably received on the upturned left and right side edges. The outer supports have lower ends positionable against a region beneath a sill of a window opening. A support bar has a central section attached to the lower surface of the lower plate adjacent to the inner edge. Telescoping sections are slidably received in the central section. The telescoping sections have forwardly extending clamps.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window air conditioner installation system which has all of the advantages of the prior art installation systems of known designs and configurations and none of the disadvantages.

It is another object of the present invention to provide a new and improved window air conditioner installation system which may be easily and efficiently manufactured and marketed.

It is further object of the present invention to provide a new and improved window air conditioner installation system which is of durable and reliable constructions.

An even further object of the present invention is to provide a new and improved window air conditioner installation system which is susceptible of a low cost of manufacture with regard to both materials and labor, and which accordingly is then susceptible of low prices of sale to the consuming public, thereby making such window air conditioner installation system economically available to the buying public.

Even still another object of the present invention is to provide a window air conditioner installation system for receiving and supporting a window air conditioner and for adjusting a supporting surface as a function of the size of the air conditioner, all without modifying the environment of the installation, the receiving and supporting being done in a safe, convenient and economical manner.

Lastly, it is an object of the present invention to provide a new and improved window air conditioner installation system. A plate assembly includes upper and lower plates. The upper plate have down turned inner and outer edges receiving inner and outer edges of the lower plate. In this manner lateral shifting is facilitated. The upper and lower plates have upturned left and right side edges. Left and right outer supports have upper ends slidably received on the upturned left and right side edges. The outer supports have lower ends positionable against a region beneath a sill of a window opening. A support bar has a central section attached to the lower surface of the lower plate adjacent to the inner edge. Telescoping sections are slidably received in the central section. The telescoping sections have forwardly extending clamps.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
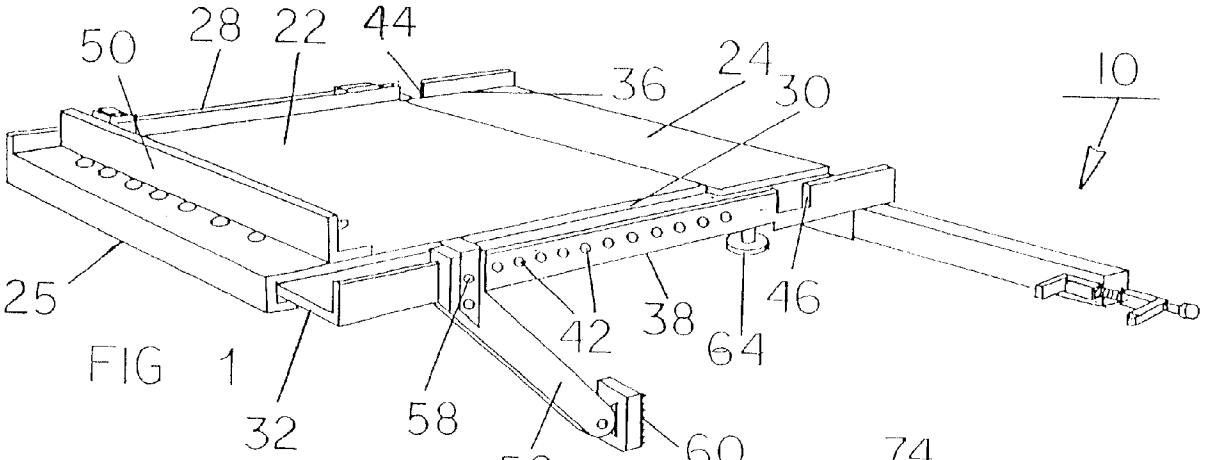
FIG. 1 is a top perspective illustration of a window air conditioner installation system constructed in accordance with the principles of the present invention.
Figure 2:
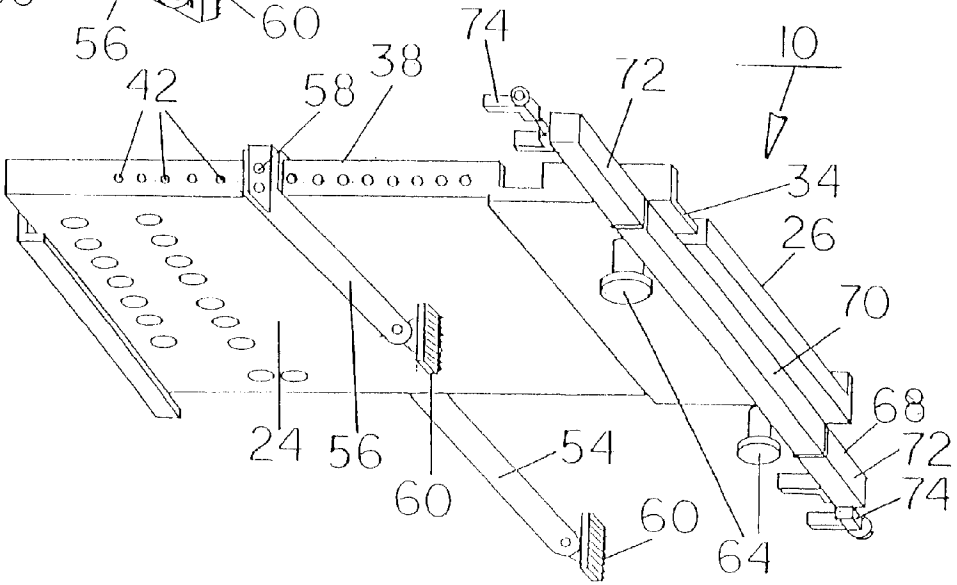
FIG. 2 is a bottom perspective illustration of the window air conditioner installation system shown in FIG. 1.
Figure 3:
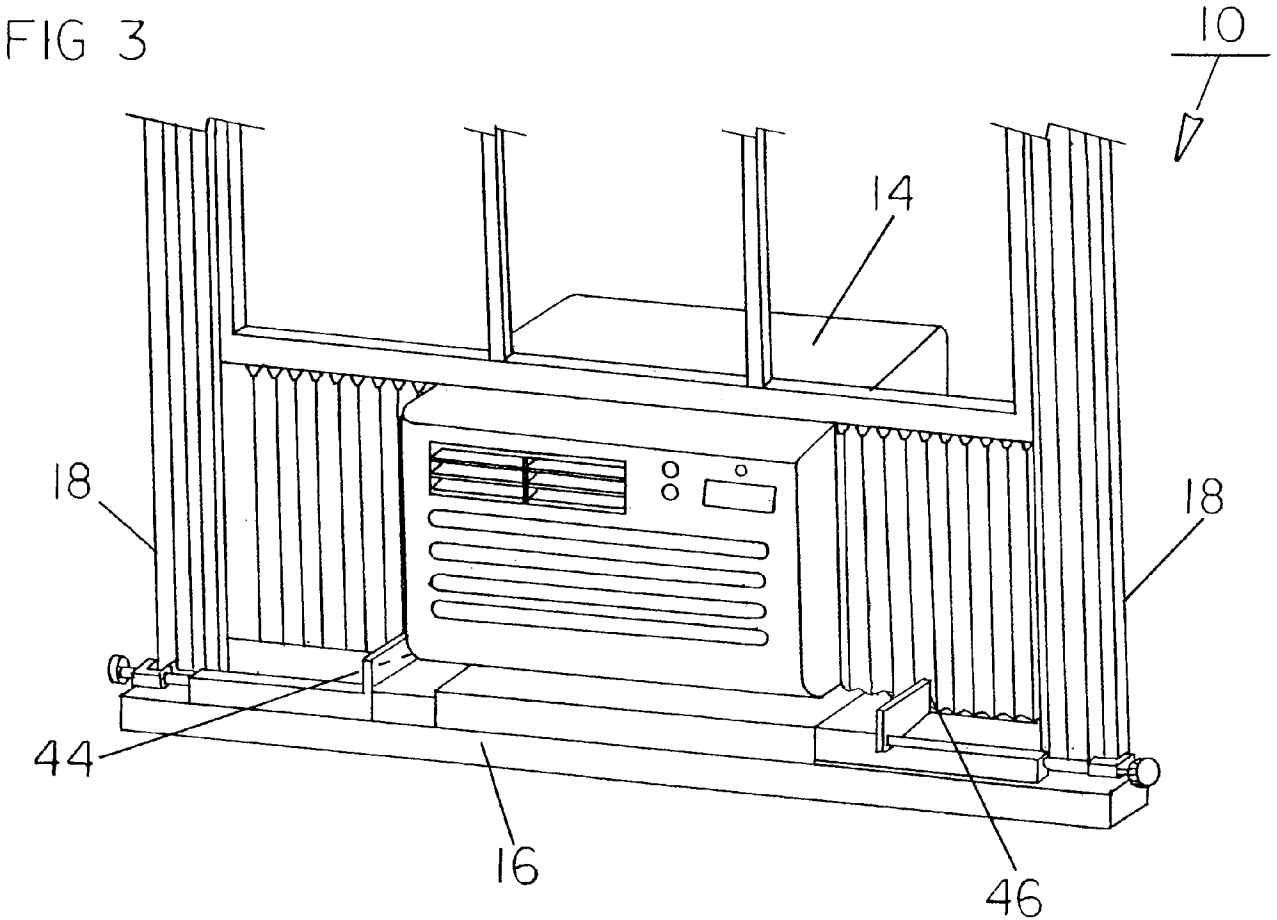
FIG. 3 is a perspective illustration of the window air conditioner installation system shown in FIGS. 1 and 2 but with a supported air conditioner.
Figure 4:
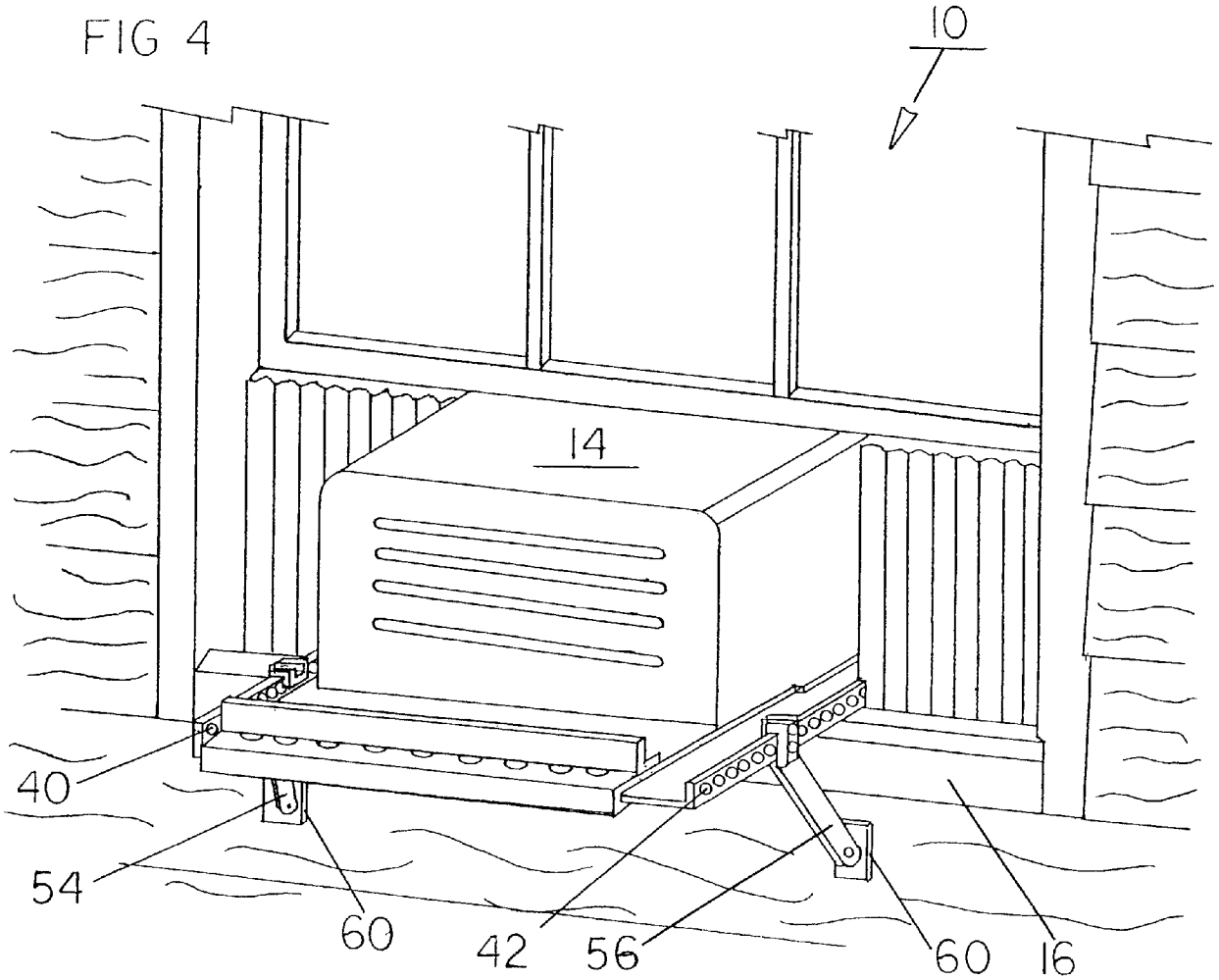
FIG. 4 is a perspective illustration similar to FIG. 3 but viewed from the outside.

With reference now to the drawings, and in particular to FIG. 1 thereof, the preferred embodiment of the new and improved window air conditioner installation system embodying the principles and concepts of the present invention and generally designated by the reference numeral 10 will be described.

The present invention, the window air conditioner installation system 10 is comprised of a plurality of components. Such components in their broadest context include a plate, left and right outer supports and a support bar. Such components are individually configured and correlated with respect to each other so as to attain the desired objective.

First provided is an air conditioner unit 14. The air conditioner unit is positionable in a building window opening. The window opening has a horizontal sill 16. The window opening has laterally spaced vertical casing 18.

A plate assembly is provided. The plate assembly includes an upper plate 22. The plate assembly includes a lower plate 24. Each plate has upper and lower surfaces. The upper plate has an outer edge 25. The upper plate has an inner edge 26. The upper plate has a left edge 28. The upper plate also has a right edge 30. The lower plate has an outer edge 32. The lower plate has an inner edge 34. The lower plate has a left edge 36. The lower plate has a right edge 38. The right edge of the upper plate is upturned. The right edge of the upper plate has a row of axially aligned right holes 40. The left edge of the lower plate is upturned. The left edge of the lower plate has a row of axially aligned left holes 42. The inner and outer edges of the upper plate are down turned. The inner and outer edges of the upper plate are in a J-shaped configuration. The inner and outer edges of the upper plate receive the inner and outer edges of the lower plate. In this manner lateral shifting of the plates with respect to each other is facilitated. The upturned left and right edges of the upper and lower plates have left and right notches 44, 46. The distance between the front and rear edges of the lower plate is less than the distance between the front and rear edges of the upper plate. In this manner the entire upper surface of the upper plate and the upper surface of the lower plate are exposed. Further in this manner the window air conditioner is received.

An upper abutment bar 50 is provided. The upper abutment bar is in an L-shaped configuration. The upper abutment bar is secured to the upper surface of the upper plate. The upper abutment bar is provided parallel with and adjacent to the outer edges. The abutment bar is adapted to abate outward shifting of a supported air conditioner.

Provided next are left and right outer supports 54, 56. The outer supports have upper ends. The upper ends are slidably received on the upturned left and right edges of the upper and lower plates. Aligned horizontal pins 58 are provided. The horizontal pins extend from the upper ends. The horizontal pins extend into selected right and left holes in the upturned left and right edges. The outer supports extend downwardly and inwardly. The outer supports have lower ends 60. The lower ends are positionable against a region beneath the sill of the window opening.

Further provided are laterally spaced leveling bolts 64. The bolts are threadedly received in the lower surface of the lower plate adjacent to the inner edge. The bolts are located in contact with the sill. The bolts are adapted to adjust the elevation of the plates and the air conditioner positioned thereon.

Provided last is a support bar 68. The support bar has a central section 70. The central section is attached to the lower surface of the lower plate adjacent to the inner edge. The support bar has telescoping sections 72. The telescoping sections are slidably received in the central section. The support bar has forwardly extending clamps 74. The clamps are adapted to removably couple to the casing. In this manner the plates are secured with respect to the window opening.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A window air conditioner installation system (10) for receiving and supporting a window air conditioner and for adjusting a supporting surface as a function of the size of the air conditioner, all without modifying the environment of the installation, the receiving and supporting being done in a safe, convenient and economical manner, the system consisting of:

an air conditioner unit (14) positionable in a building window opening, the window opening having a horizontal sill (16) and laterally spaced vertical casing (18);

a plate assembly including an upper plate (22) and a lower plate (24), each plate having upper and lower surfaces, the upper plate having an outer edge (25) and an inner edge (26) and a left edge (28) and a right edge (30), the lower plate having an outer edge (32) and an inner edge (34) and a left edge (36) and a right edge (38), the right edge of the upper plate being upturned with a row of axially aligned right holes (40) with horizontal axes, the left edge of the lower plate being upturned with a row of axially aligned left holes (42) with horizontal axes, the inner and outer edges of the upper plate being down turned in a J-shaped configuration receiving the inner and outer edges of the lower plate to facilitate the lateral shifting of the plates with respect to each other, left and right notches (44), (46) to facilitate the passage of accordion panels laterally spaced from an air conditioner unit, upturned left and right edges of the upper and lower plates, the distance between the front and rear edges of the lower plate being less than the distance between the front and rear edges of the upper plate whereby the entire upper surface of the upper plate and the upper surface of the lower plate are exposed for receiving the window conditioner;

an upper abutment bar (50) in an L-shaped configuration secured to the upper surface of the upper plate parallel with and adjacent to the outer edges, the abutment bar adapted to abate outward shifting of a supported air conditioner;

left and right outer supports (54), (56) having upper ends slidably received on the upturned left and right edges of the upper and lower plates, aligned horizontal pins (58) extending from the upper ends into selected right and left holes in the upturned left and right edges, the outer supports extending downwardly and inwardly with lower ends (60) positionable against a region beneath the sill of the window opening;

laterally spaced leveling bolts (64) threadedly received in the lower surface of the lower plate adjacent to the inner edge, the bolts located in contact with the sill and adapted to adjust the elevation of the plates and the air conditioner positioned thereon; and a support bar (68) formed of a central section (70) attached to the lower surface of the lower plate adjacent to the inner edge, telescoping sections (72) slidably received in the central section to vary the length of the support bar as a function of the width of a window opening, forwardly extending clamps (74) adapted to removably couple to a vertical extent of the casing of the window opening supporting the air conditioner unit for securement of the plates with respect to the window opening.

* * * * *